US007192367B2

(12) United States Patent
Ninomiya et al.

(10) Patent No.: US 7,192,367 B2
(45) Date of Patent: Mar. 20, 2007

(54) MULTI-PIECE GOLF BALL, MANUFACTURING METHOD THEREOF AND MOLD FOR MANUFACTURING THE SAME

(75) Inventors: Norikazu Ninomiya, Osaka (JP); Kenji Onoda, Kashihara (JP); Masao Ogawa, Osaka (JP); Yuri Naka, Katano (JP)

(73) Assignee: Mizuno Corporation, Osaka (JP)

( * ) Notice: Subject to any disclaimer, the term of this patent is extended or adjusted under 35 U.S.C. 154(b) by 146 days.

(21) Appl. No.: 10/809,864

(22) Filed: Mar. 26, 2004

(65) Prior Publication Data

US 2004/0254031 A1 Dec. 16, 2004

(30) Foreign Application Priority Data

Mar. 31, 2003 (JP) ..... 2003-097285

(51) Int. Cl.
*A63B 37/06* (2006.01)

(52) U.S. Cl. ..... 473/374

(58) Field of Classification Search ..... 473/373, 473/374, 376, 377
See application file for complete search history.

(56) References Cited

U.S. PATENT DOCUMENTS

| | | | | |
|---|---|---|---|---|
| 698,516 | A | 4/1902 | Kempshall | |
| 4,173,345 | A | 11/1979 | Pocklington | |
| 4,229,401 | A | 10/1980 | Pocklington | |
| 4,660,830 | A | 4/1987 | Tomar | |
| 5,692,973 | A * | 12/1997 | Dalton | 473/374 |
| 5,820,485 | A * | 10/1998 | Hwang | 473/361 |
| 5,836,834 | A | 11/1998 | Masutani et al. | |
| 5,984,807 | A | 11/1999 | Wai et al. | |
| 6,004,226 | A | 12/1999 | Asakura | |
| 6,039,910 | A | 3/2000 | Tanaka et al. | |
| 6,126,560 | A | 10/2000 | Maruoka et al. | |
| 6,155,935 | A * | 12/2000 | Maruko | 473/361 |
| 6,213,893 | B1 | 4/2001 | Maruko et al. | |
| 6,217,462 | B1 | 4/2001 | Maruko et al. | |
| 6,293,877 | B1 | 9/2001 | Boehm | |
| 6,296,578 | B1 | 10/2001 | Masutani | |
| 6,398,667 | B1 | 6/2002 | Lemons | |

(Continued)

FOREIGN PATENT DOCUMENTS

| | | |
|---|---|---|
| JP | 40-003456 | 1/1940 |

(Continued)

*Primary Examiner*—Raeann Gorden
(74) *Attorney, Agent, or Firm*—Armstrong, Kratz, Quintos, Hanson & Brooks, LLP

(57) ABSTRACT

The present invention provides a multi-piece golf ball comprising a core 3, a first intermediate layer 5, a second intermediate layer 7, and a cover 9, wherein the first intermediate layer 5 comprises a plurality of ribs 51 formed on the core 3; the second intermediate layer 7 is placed in concave portions surrounded by the ribs 51; and the cover 9 forms an outermost layer; with each of the ribs extending so that its width increases from the cover side to the core side; the concave portions being shaped into a funnel-like form by the side surfaces of the ribs; the hardness of the core 3, the first intermediate layer 5 and the second intermediate layer 7 being different from each other; and the hardness of the first intermediate layer 5 being greater than that of the second intermediate layer 9.

9 Claims, 9 Drawing Sheets

U.S. PATENT DOCUMENTS

| | | | | |
|---|---|---|---|---|
| 6,835,146 | B2 | 12/2004 | Jordan et al. | |
| 6,955,613 | B2 * | 10/2005 | Ninomiya et al. | 473/367 |
| 2002/0016225 | A1 * | 2/2002 | Maruko et al. | 473/377 |
| 2003/0083153 | A1 | 5/2003 | Sullivan et al. | |
| 2004/0138006 | A1 | 7/2004 | Ninomiya et al. | |
| 2004/0254031 | A1 | 12/2004 | Ninomiya et al. | |

FOREIGN PATENT DOCUMENTS

| | | |
|---|---|---|
| JP | 49-136364 | 3/1948 |
| JP | 60-241463 | 11/1985 |
| JP | 62-073932 | 4/1987 |
| JP | 62-270178 | 11/1987 |
| JP | 03-052310 | 3/1991 |
| JP | 10-337340 | 12/1998 |
| JP | 2000-084120 | 3/2000 |
| JP | 2000-288122 | 10/2000 |
| JP | 2001-112889 | 4/2001 |
| JP | 2001-112890 | 4/2001 |
| JP | 2001-340493 | 12/2001 |
| JP | 2004-041743 | 2/2004 |
| JP | WO 2004/087265 | 10/2004 |

* cited by examiner (b)

Fig. 10

| | | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|---|
| Core | Specific gravity | 1.08 | 1.08 | 1.08 | 1.08 | 1.08 | 1.08 | 1.2 | 1.2 |
| | Shore D hardness | 40 | 40 | 40 | 50 | 40 | 40 | 40 | 50 |
| | BR | 100 | 100 | 100 | 100 | 100 | 100 | 100 | 100 |
| | Zinc oxide | 5 | 5 | 5 | 4 | 5 | 5 | 5 | 5 |
| | Barium sulfate | 5 | 5 | 5 | 2 | 5 | 5 | 25 | 22 |
| | Peroxide | 1 | 1 | 1 | 1 | 1 | 1 | 1 | 1 |
| | Zinc acrylate | 21 | 21 | 21 | 31 | 21 | 21 | 21 | 31 |
| | Antioxidant | 0.1 | 0.1 | 0.1 | 0.1 | 0.1 | 0.1 | 0.1 | 0.1 |
| First intermediate layer | Specific gravity | 1.16 | 1.2 | 1.14 | 1.16 | 1.2 | 1.14 | 1.2 | 1.2 |
| | Shore D hardness | 50 | 50 | 50 | 45 | 50 | 50 | 50 | 45 |
| | BR | 100 | 100 | 100 | 100 | 100 | 100 | 100 | 100 |
| | Zinc oxide | 5 | 5 | 5 | 5 | 5 | 5 | 5 | 5 |
| | Barium sulfate | 15 | 22 | 11 | 16 | 22 | 11 | 22 | 23 |
| | Peroxide | 1 | 1 | 1 | 1 | 1 | 1 | 1 | 1 |
| | Zinc acrylate | 31 | 31 | 31 | 26 | 31 | 31 | 31 | 26 |
| | Antioxidant | 0.1 | 0.1 | 0.1 | 0.1 | 0.1 | 0.1 | 0.1 | 0.1 |
| Second intermediate layer | Specific gravity | 1.25 | 1.25 | 1.23 | 1.25 | 1.25 | 1.23 | 1.13 | 1.13 |
| | Shore D hardness | 43 | 45 | 43 | 40 | 45 | 43 | 43 | 40 |
| | BR | 100 | 100 | 100 | 100 | 100 | 100 | 100 | 100 |
| | Zinc oxide | 5 | 5 | 5 | 5 | 5 | 5 | 5 | 5 |
| | Barium sulfate | 33 | 32 | 30 | 34 | 32 | 33 | 12 | 13 |
| | Peroxide | 1 | 1 | 1 | 1 | 1 | 1 | 1 | 1 |
| | Zinc acrylate | 24 | 26 | 24 | 21 | 26 | 24 | 24 | 21 |
| | Antioxidant | 0.1 | 0.1 | 0.1 | 0.1 | 0.1 | 0.1 | 0.1 | 0.1 |
| Cover | HIMILAN 1706 | 50 | 50 | 50 | 50 | 50 | 50 | 50 | 50 |
| | HIMILAN 1605 | 50 | 50 | 50 | 50 | 50 | 50 | 50 | 50 |

Unit: Part by weight

Fig. 11

| | | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|---|
| Rib | | Present | Present | Present | Present | Present | Present | Not present | Not present |
| Core | Diameter (mm) | 23.3 | 26.5 | 16.9 | 23.3 | 26.9 | 16.5 | 32.3 | 32.3 |
| | Hardness | 40 | 40 | 40 | 50 | 40 | 40 | 40 | 50 |
| First intermediate layer | Thickness (Rib height) (mm) | 8.0 | 6.4 | 11.2 | 8.0 | 6.2 | 11.4 | 2.0 | 2.0 |
| | Hardness | 50 | 50 | 50 | 45 | 50 | 50 | 50 | 45 |
| Second intermediate layer | Thickness (mm) | 8.0 | 6.4 | 11.2 | 8.0 | 6.2 | 11.4 | 1.5 | 1.5 |
| | Hardness | 43 | 45 | 43 | 40 | 45 | 43 | 43 | 40 |
| Cover | Thickness (mm) | 1.7 | 1.7 | 1.7 | 1.7 | 1.7 | 1.7 | 1.7 | 1.7 |
| | Hardness | 62 | 62 | 62 | 62 | 62 | 62 | 62 | 62 |

Fig. 12

| | | Example 1 | Example 2 | Example 3 | Example 4 | Comp. Ex. 1 | Comp. Ex. 2 | Comp. Ex. 3 | Comp. Ex. 4 |
|---|---|---|---|---|---|---|---|---|---|
| 1W | Carry (m) | 200.2 | 199.7 | 197.9 | 197.7 | 194.5 | 194.2 | 194.1 | 192.5 |
| | Total (m) | 212.2 | 211.4 | 208.1 | 206.5 | 211.0 | 205.4 | 206.4 | 201.9 |
| | Back Spin (rpm) | 2501 | 2510 | 2488 | 2912 | 2524 | 2460 | 2411 | 2811 |
| | Feeling | Excellent | Excellent | Excellent | Excellent | Excellent | Too soft | Excellent | Too soft |
| 5W | Carry (m) | 150.2 | 150.5 | 149.0 | 148.3 | 149.5 | 145.0 | 146.0 | 144.2 |
| | Total (m) | 158.0 | 158.3 | 156.9 | 151.2 | 159.5 | 153.8 | 157.3 | 1478.2 |
| | Back Spin (rpm) | 4492 | 4481 | 4518 | 5224 | 4398 | 4711 | 4342 | 5118 |
| | Feeling | Excellent | Excellent | Excellent | Excellent | Hard | Too soft | Excellent | Too soft |

MULTI-PIECE GOLF BALL, MANUFACTURING METHOD THEREOF AND MOLD FOR MANUFACTURING THE SAME

TECHNICAL FIELD

The present invention relates to a multi-piece golf ball having a multi-layered structure, a method for manufacturing the same and a mold used for manufacturing the same.

BACKGROUND ART

Recently, several golf balls exhibiting both high ball bounce resilience and a soft feel when hit have been proposed. One example of such golf balls is a multi-piece golf ball in which the ball is composed of a plurality of layers. Generally, in a multi-layered golf ball, especially in a golf gall that has three or more layers, a highly rigid core is covered with an intermediate layer that has relatively low rigidity, and the outer surface of the intermediate layer is covered with a hard cover. This arrangement aims to attain both high ball bounce resilience and a soft feel when hit by using the rigidity of the core and the softness of the intermediate layer. One example of such a multi-piece golf ball is disclosed in Japanese Examined Patent Publication No. 1991-52310.

However, golf balls having a conventional multi-layer structure do not always exhibit a satisfactorily soft feel when hit and further improvement in this soft feel is desired.

The properties required in golf balls include a long carry distance attributable to the above-mentioned high ball bounce resilience and to the spin; however, it is difficult to provide both properties in the same ball. Therefore, in commonly marketed golf balls, only one of the properties is generally enhanced. Because different properties are required in different types of golf balls, it is difficult to manufacture them using the same mold, thus increasing the number of manufacturing steps. From the view of reducing the cost of molds, the demand exists for sharing the same mold for manufacturing different types of golf balls.

The present invention aims to solve the above problems. The first object of the present invention is to provide multi-piece golf balls having a satisfactorily soft feel and high ball bounce resilience. The second object of the present invention is to provide a method for manufacturing multi-piece golf balls that can achieve both a long carry distance and satisfactory spin, which are inherently conflicting properties, using the same mold, and a mold for manufacturing such golf balls.

DISCLOSURE OF THE INVENTION

The multi-piece golf ball of the present invention comprises a core, a first intermediate layer, a second intermediate layer, and a cover. To overcome the previously mentioned problems, the first intermediate layer comprises a plurality of ribs formed on the core, the second intermediate layer is placed in the concave portions surrounded by ribs, and the cover forms an outermost layer; such that the ribs extend in such a manner that the width of the ribs widens from the cover to the core, and the concave portions are formed into a cone-like shape by the side surfaces of the ribs, the hardness of the core, the first intermediate layer and the second intermediate layer are different from each other and the hardness of the first intermediate layer is greater than that of the second intermediate layer.

In this structure, the first intermediate layer formed on the surface of the core comprises a plurality of ribs, and the second intermediate layer is placed in the concave portions surrounded by the ribs. Each of the ribs extends such that its width is greater as approaching to the core, and this forms each concave portion into a funnel-like form. Therefore, in the region between the core and the cover, the area occupied by the first intermediate layer increases when moving from the cover to the core in concentric spherical surfaces. In other words, the proportion of the area of the second intermediate layer in the vicinity of the cover is large, while the proportion of the area of the first intermediate layer increases towards the core, so that the intermediate layers between the core and the cover have functionally graded properties in which two properties gradually change.

In the present invention, the hardness of the first intermediate layer is greater than that of the second intermediate layer, and therefore the hardness of the ball gradually increases from the cover to the core. Therefore, the initial stage of impact is greatly influenced by those properties that contribute to soft feel and, as impact progresses, ball bounce resilience increases. In the multi-piece golf ball of the present invention, because two contrasting properties smoothly change during impact, both excellent soft feel and high ball bounce resilience can be obtained, improving the balance of the properties of the ball.

When, as described above, the hardness of the first intermediate layer is set greater than that of the second intermediate layer, because the second intermediate layer having the lower hardness is placed in concave portions surrounded by harder ribs, deformation of the second intermediate layer in the spherical surface direction when hit is limited by the ribs. This makes it possible to prevent the striking force from being dispersed in directions along the spherical surface and to highly efficiently transmit the striking force to the center of the ball. As a result, in spit of the soft feel when hit, it is also possible to achieve a long carry distance.

In the present invention, "cone-like shape" means a shape such that each concave portion forms a cone-like-shape region by being surrounded by the side surfaces of ribs such that the area of the plane formed by cutting the region along a spherical surface having the same center as the core becomes smaller as approaching from the cover to the core. In this case, the shape of the above-described plane is not limited and may be, for example, a polygonal or circular. In some embodiments, the concave portion is formed into a cone-like shape by being surrounded only by ribs, while in other embodiments, the core is exposed at the bottom end of the concave portion and the side surfaces of the rib and the core together define the cone-like shape. However, when the core is exposed, the exposed area is small and a cone-like shape is formed as a whole. It is preferable that the height of the ribs be set in the range from 6.4 to 11.2 mm.

When the hardness of the core is set less than that of the second intermediate layer, i.e., the hardness of the core is made less than that of both the intermediate layers, even when the intermediate layers act to rotate the ball, because the soft core reduces the rotation, the rotation of the ball is controlled. This reduces the amount of spin and increases the shot angle, obtaining a long carry distance.

In contrast, when the hardness of the core is greater than that of the first intermediate layer, i.e., the hardness of the core is made greater than both the intermediate layers, when the less hard intermediate layers start rotating, the core follows this motion, increasing the amount of spin of the ball. Therefore, although the carry distance is less than desired, a high spin performance can be attained.

It is preferable that the diameter of the core of the golf ball be set in the range from 15.1 to 28.3 mm. The diameter of the core may be set outside this range; however, setting the diameter of the core within this range makes it possible to reduce the diameter of the core and increase the region between the core and the cover, i.e., the region in the radial direction is broad and the balance between soft feel and high ball bounce resilience is improved. In other words, feeling when hit the ball becomes satisfactorily soft and a long carry distance can be achieved at the same time.

Various configurations are possible as a rib structure, for example, ribs may extend along three great circles drawn around the core so as to intersect each other at right angles.

In the golf ball of the present invention, the ribs comprising the first intermediate layer may be configured various ways. For example, each of the ribs may comprise a notch so as to form a passageway between adjacent concave portions.

Forming a notch in the ribs can be advantageous during manufacturing. For example, when a golf ball of the present invention is manufactured in the manner of forming a core, covering the core with the first intermediate layer, placing it in a mold together with a material for the second intermediate layer and press molding, because the adjacent concave portions communicate with each other via the notches, when press molding is conducted, the material for the second intermediate layer spreads throughout the concave portions through the notches.

This makes it unnecessary to separately fill the material for the second intermediate layer in each of the concave portions, simplifying the manufacturing facility and reducing the manufacturing time. When the second intermediate layer is formed by injection molding, the second intermediate layer can be formed by using one or a small number of gates, reducing the production facility cost.

It is preferable that each of the ribs extend along three great circles drawn around the core so as to intersect each other at right angles, each circular arc section of the ribs divided at the intersections of the great circles being provided with a notch, the notch has a plane that extends from one point of the normal line of the core passing through the intersection of the great circles toward the circular arc section, wherein the plane has an angle that is not smaller than 90° relative to the normal line. Thereby, four concave portions that are arranged so as to have their common center at an intersection of the great circles are made to communicate with each other, and the material for the second intermediate layer can readily spread between them. Because the angle made between the plane and the normal line is not smaller than 90°, the angle serves as a draft angle, and, for example, when the core is molded using two molds, such as an upper mold and a lower mold, the core can easily be removed from the mold.

From the view of making adjacent concave portions communicate with each other, it is possible to form a notch in the middle of the circular arc section in the circular direction. It is preferable that the notch have two planes that each extends toward the intersection from a point on the normal line of the spherical body that passes through the mid point of each circular arc section in the circular direction, wherein the angle made between the planes and the normal line is 45 to 48°. This arrangement allows the above angle made between the planes and the normal line to serve as a draft angle, so that the first intermediate layer can be removed from the mold easily.

The method for manufacturing a multi-piece golf ball comprising a core, a first intermediate layer, a second intermediate layer and a cover, the method comprising the steps of forming a spherical core; preparing a first mold having a spherical core receiving part corresponding to the surface of the core, and the cavity having a plurality of grooves formed along the surfaces of the core receiving part, the grooves having substantially the same depth measured from the surface and their width becoming narrower as they become deeper; placing the core in the core receiving part of the first mold and then forming a first intermediate layer having a plurality of ribs by filling the cavity with a material having a hardness and/or specific gravity different from that of the core; preparing a second mold having a spherical cavity corresponding to the outermost diameter of the first intermediate layer; forming a second intermediate layer by placing a half-finished product comprising the core released from the first mold and the first intermediate layer in the cavity of the second mold, and filling the concave portions surrounded by the ribs with a material having a hardness and/or specific gravity different from that of the core and the first intermediate layer; and forming a cover over the second intermediate layer.

This manufacturing method makes it possible to obtain a multi-piece golf ball that has functionally graded properties between the cover and the core as described above and that achieves excellent performance. It is also possible to readily align the center of each layer. Furthermore, multi-piece golf balls having various properties can be manufactured by varying the materials for each intermediate layer or core. For example, when the materials are selected in such a manner that the hardness of the first intermediate layer is greater than that of the second intermediate layer, a golf ball having a hardness gradually increasing from the cover to the core can be manufactured, thus obtaining a golf ball having both high ball bounce resilience and soft feel.

When the materials are selected in such a manner that the hardness of the core is less than those of the intermediate layers, it is possible to manufacture a ball achieving a long carry distance, and when the materials are selected in such a manner that the hardness of the core is greater than those of the intermediate layers, it is possible to manufacture a ball having an excellent spin performance. Therefore, merely by varying the materials, golf balls having different excellent performance properties can be manufactured using the same mold. Furthermore, it is also possible to manufacture golf balls of various properties by varying not only hardness but also the specific gravities of the materials.

When the inside diameter of the core receiving part in the first mold is set in the range from 15.1 to 28.3 mm, it is possible to manufacture a golf ball having a good balance between soft feel and high ball bounce resilience. It is preferable that the depth of the grooves comprising the cavity be 6.4 to 11.2 mm.

When the cavity of the first mold is so structured that a plurality of grooves communicate with each other to form at least one closed region, and at least one shallower portion is formed in the grooves, a notch can be formed on a rib and the material can readily spread throughout each concave portion during the second intermediate layer formation step.

A first mold of the present invention is a mold for forming a first intermediate layer of a multi-piece golf ball, the mold comprising a spherical core receiving part corresponding to the surface of the core; and a cavity having a plurality of grooves formed along the surfaces of the core receiving part, the plurality of grooves having substantially the same depth measured from the surface and a width becoming narrower as they become deeper.

A second mold of the present invention is a mold for forming a second intermediate layer of a multi-piece golf ball, the mold comprising a spherical cavity corresponding to the outermost diameter of the first intermediate layer.

BRIEF DESCRIPTION OF THE DRAWINGS

FIG. 10 is a table listing the constituent components of the golf balls in the Examples and Comparative Examples.

FIG. 11 is a table showing the sizes of the golf balls in the Examples and Comparative Examples.

FIG. 12 is a table showing the test results of the golf balls in the Examples and Comparative Examples.

BEST MODE FOR CARRYING OUT THE INVENTION

Figure 1:
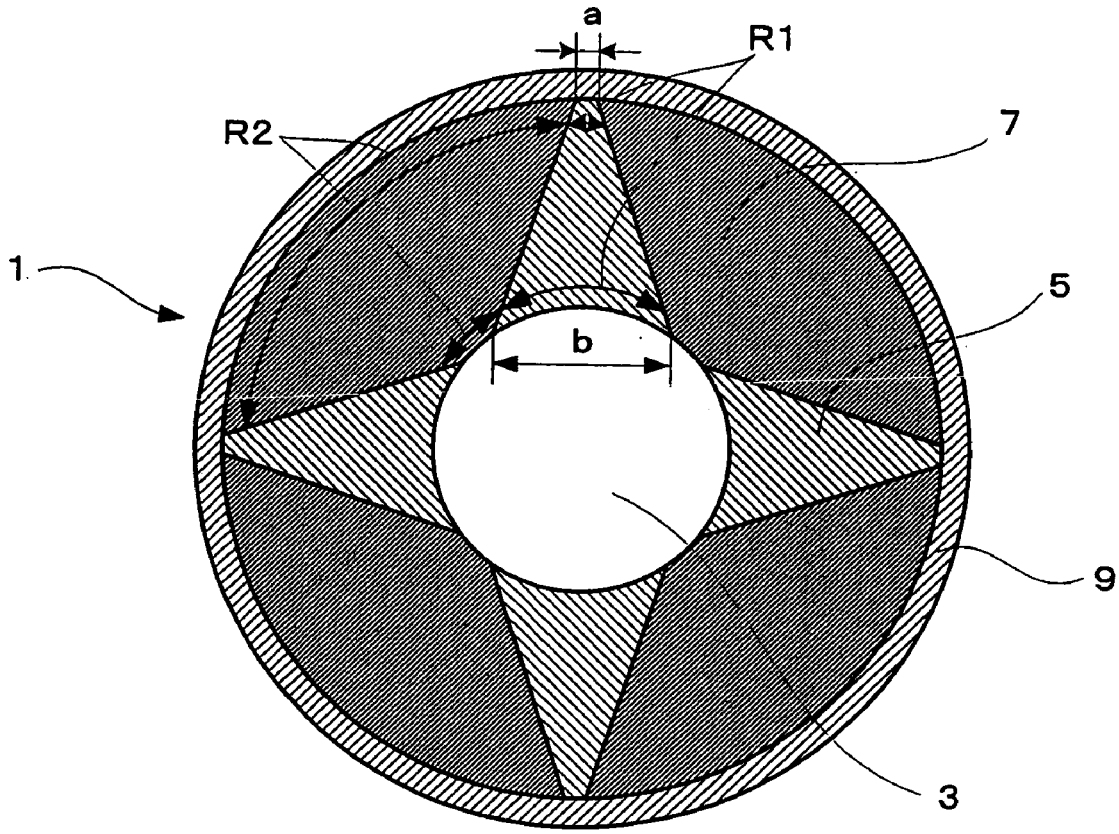
FIG. 1 is a cross-sectional view taken along lines I—I of FIG. 2. showing one embodiment of the golf ball of the present invention.

Hereunder, embodiments of a multi-piece golf ball of the present invention are explained with reference to drawings. FIG. 1 is a cross-sectional view showing one embodiment of the golf ball of the present invention.

As shown in FIG. 1, a golf ball 1 of the present embodiment is a so-called four-piece golf ball covering a core 3 with a first intermediate layer 5, a second intermediate layer 7, and a cover 9. According to the rules (see R&A and USGA), the diameter of a golf ball should be no smaller than 42.67 mm. However, taking aerodynamic characteristics and the like into consideration, it is preferable that the diameter of the ball be as small as possible. Therefore, it can be, for example, in the range from 42.7 to 43.7 mm.

Figure 2:
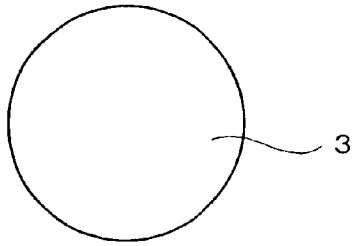
FIG. 2 is a perspective view showing the core, a first intermediate layer and a second intermediate layer of the golf ball of FIG. 1.
Figure 2:
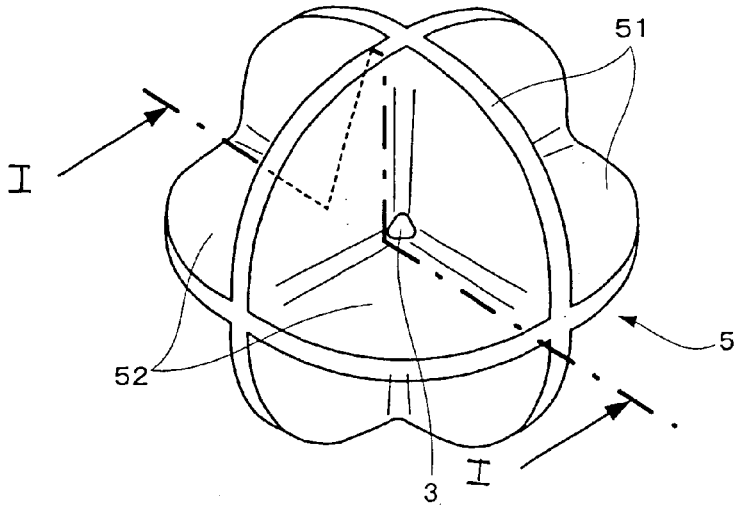
Figure 2:
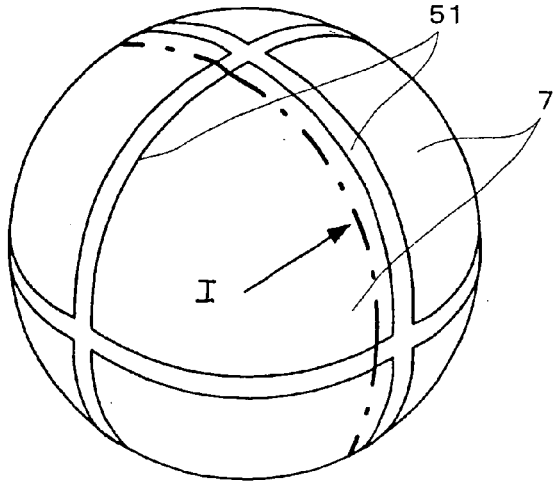

FIG. 2 is a perspective view showing (a) a core, (b) a half-finished product with the core covered by a first intermediate layer and (c) a half-finished product with the half-finished product (b) being covered by a second intermediate layer. The core 3 is formed into a spherical shape as shown in FIG. 2(*a*), and formed from a rubber composition. It is preferable that the diameter of the core be set in the range from 15.1 to 28.3 mm and more preferably from 17.9 to 25.9 mm. It is preferable that the Shore D hardness of the core be 35 to 55.

The core 3 can be manufactured using a known rubber composition comprising a base rubber, a cross-linking agent, an unsaturated carboxylic acid metal salt, filler, etc. Specific examples of base rubber include natural rubber, polyisobutylene rubber, styrenebutadiene rubber, EPDM, etc. Among these, it is preferable to use high-cis polybutadiene that contains 40% or more cis-1,4-bonds and preferably 80% or more.

Specific examples of cross-linking agents include dicumyl peroxide, t-butylperoxide, and like organic peroxides; however, it is particularly preferable to use dicumyl peroxide. The compounding ratio of the cross-linking agent is generally 0.3 to 5 parts by weight, and preferably 0.5 to 2 parts by weight based on 100 parts by weight of the base rubber.

As metal salts of unsaturated carboxylic acids, it is preferable to use monovalent or bivalent metal salts of acrylic acid, methacrylic acid, and like $C_3$ to $C_8$ unsaturated carboxylic acids. Among these, use of zinc acrylate can improve the ball bounce resilience and is particularly preferable. The compounding ratio of the unsaturated carboxylic acid metal salt is preferably 10 to 40 parts by weight based on 100 parts by weight of base rubber.

Examples of filler include those generally added to cores. Specific examples thereof include zinc oxide, barium sulfate, calcium carbonate, etc. The preferable compounding ratio of the filler is 2 to 50 parts by weight based on 100 parts by weight of base rubber. If necessary, it is also possible to add an antioxidant, a peptizer, and the like.

Known elastomers, in addition to the above-mentioned rubber compositions, can also be used as materials for forming the core 3.

As shown in FIG. 2(*b*), the first intermediate layer 5 is composed of three ribs (protrusions) 51 intersecting each other at right angles around the surface of the core 3. Specifically, each of the ribs 51 extends along one of three great circles drawn around the core 3 so as to intersect each other at right angles. These ribs form eight concave portions 52 above the surface of the core 3. It is preferable that the height of the ribs 51 be 6.4 to 11.2 mm and more preferably 7.2 to 10.2 mm. The height of the ribs 51 may be set outside this range; however, having the height of the ribs 51 within this range makes it possible to obtain a suitable length in the radial direction for the functionally graded portion as described later. It is preferable that the first intermediate layer 5 composing the ribs 51 has a hardness greater than the core, for example, its Shore D hardness is preferably 40 to 55. When the ribs 51 are shorter than, for example, 6.4 mm, satisfactorily functionally graded properties cannot be attained and this arises a problem that soft feel is difficult to obtain. In contrast, when the height of the rib is greater than 11.2 mm, as described later, the area of soft region becomes too large and ball bounce resilience decreases, and this may also cause problems with rib deformation during manufacturing it.

As shown in FIG. 1, the ribs 51 are structured so as to have a trapezoidal profile in their sideways cross-section in such a manner that their width increases as it comes closer the core 3. It is preferable that the width of the end portion a of each rib in the outward radial direction be 1.5 to 3.0 mm and the width of the end portion b in the inward radial direction be 7 to 12 mm. The widths of the ribs may be set outside this range; however, by setting a lower limit for the width of each end portion of the ribs 11, it is possible to prevent the ribs 11 from being deformed by the filling pressure that is attributable to the pressure of tightly closing the mold when filling the material for the intermediate layer during the manufacturing process. As a result, it is possible to accurately hold the core 3 in the center of the mold. Furthermore, by setting an upper limit for the widths of each end portion of the ribs 51 as described above, it is possible to prevent areas where the hard ribs 51 and inner surface of the cover 9 contact each other from becoming unduly large, and this enables an adequately soft feel to be maintained when hit the ball.

Note that, it is preferable that the width b of the rib end portion be set in the above range and the core 3 be exposed at the bottom surfaces of the concave portions 52 as shown in FIGS. 1 and 2(*b*). As described latter, this arrangement makes it readily possible to accurately align the center of the core 3 with the center of the first intermediate layer 5.

Because of this shape of the ribs 51, the concave portions 52 form a trigonal pyramid-like shape surrounded by three ribs 51 and the surface of the core 3 that is slightly exposed.

The first intermediate layer 5 is composed of a rubber composition, and the same materials as used for the core 3 described above can be used. However, it is preferable that the compounding ratio of unsaturated carboxylic acids and organic peroxides be increased to make the intermediate layer harder than the core 3.

As shown in FIG. 1, each of the second intermediate layer 7 has a substantially the same thickness as the height of the ribs 51 and is situated in each of the eight concave portions 52 surrounded by the ribs 51, and their outline forms a substantially spherical shape. The second intermediate layer 7 is formed into trigonal pyramid-like shapes by being placed in each of the concave portions 51. As shown in FIG. 2(*c*), the tops of the ribs 51 are exposed through the second intermediate layer 7. The hardness of the second intermediate layer 7 is less than that of the first intermediate layer 5, and greater than that of the core 3. It is preferable that the Shore D hardness of the second intermediate layer 7 be 35 to 50.

It is possible to form the second intermediate layer 7 using rubber compositions or elastomers having almost the same components as those used for the core 3. However, when the second intermediate layer 7 is composed of a rubber compound, it is preferable that the compounding ratio of unsaturated carboxylic acids and organic peroxides be reduced to make the intermediate layer less hard than the first intermediate layer.

When the intermediate layer 5 is formed of an elastomer, it is possible to use, for example, styrene/butadiene/styrene block copolymer (SBS), styrene/isoprene/styrene block copolymer (SIS), styrene/ethylene/butylene/styrene block copolymer (SEBS), styrene/ethylene/propylene/styrene block copolymer (SEPS), and like styrene-based thermoplastic elastomers; olefin-based thermoplastic elastomers having polyethylene or polypropylene as a hard segment and butadiene rubber, acrylonitrile butadiene rubber or ethylene/propylene rubber as a soft segment; vinyl chloride-based plastic elastomers having crystallized poly(vinyl chloride) as a hard segment and amorphous poly(vinyl chloride) or an acrylonitrile butadiene rubber as a soft segment; urethane-based plastic elastomers having polyurethane as a hard segment and polyether or polyester urethane as a soft segment; polyester based plastic elastomers having polyester as a hard segment and polyether or polyester as a soft segment; amide based plastic elastomers having polyamide as a hard segment and polyether or polyester as a soft segment; ionomer resins; balata rubber, etc.

As shown in FIG. 1, the cover 9 covers the top portions of the ribs 51 and the second intermediate layer 7, with predetermined dimples (not shown) being formed on the outer surface of the cover 9. It is preferable that the thickness of the cover 9 be 0.8 to 2.6 mm, and more preferably 1.2 to 2.2 mm. The thickness of the cover 9 can be set outside this range; however, if the thickness of the cover 7 is less than 0.8 mm, the durability of the cover decreases remarkably and molding becomes difficult. On the other hand, if it exceeds 2.6 mm, the feel when hit becomes too hard. It is preferable that its Shore D hardness be 48 to 72. The cover 9 can be composed of known elastomers, and therefore the same elastomers that compose the second intermediate layer 7 can be used. Note that the thickness of the cover 9 is defined as the distance between an arbitrary point on the outermost part where no dimple is formed in the outward radial direction and another arbitrary point in contact with the intermediate layer measured along the normal line.

A golf ball 1 having such a structure comprises a first intermediate layer 5 formed on the surface of a core 3, the first intermediate layer having three ribs 51 extending along great circles, and the second intermediate layer 7 being placed in the eight concave portions 52 surrounded by the ribs 51. Therefore, in the region between the core 3 and the cover 9, the area occupied by the first intermediate layer 5 of a spherical surface concentric to the core 3 increases from the cover 9 to the core 3. In other words, as shown in FIG. 1, in the vicinity of the cover 9, the proportion R2 of the second intermediate layer 7 is large. In contrast, the proportion R1 of the first intermediate layer 7 becomes larger toward the core 3. In the multi-piece golf ball of the present embodiment, because the hardness of the first intermediate layer 5 is greater than that of the second intermediate layer 7, the ball is overall softer in the vicinity of the cover 9, strongly reflecting the property of the second intermediate layer 7, and gradually becomes harder near the core 3, strongly reflecting the property of the first intermediate layer 5. Because the hardness of the intermediate layer 5 is low in the vicinity of the cover 9, soft feel can be obtained in the initial stage of impact, while the hardness increases as impact progresses, obtaining high ball bounce resilience. Because the golf ball 1 of the present embodiment has functionally graded properties in which the hardness thereof smoothly changes in the region between the cover 9 and the core 3, it achieves a good balance between soft feel and high ball bounce resilience.

In this structure, because the softer second intermediate layer 7 is placed in the concave portions 52 surrounded by the harder ribs 51, deformation of the second intermediate layer 7 in the spherical surface direction is limited by the ribs 51. It is possible to prevent the striking force from being dispersed in directions along the spherical surface, efficiently transferring the striking force to the center of the ball. As a result, in spite of the soft feel, a long carry distance can be attained.

Because the hardness of the core 3 is less than that of the intermediate layers 5 and 7, even if the intermediate layers 5 and 7 rotate, the rotation is controlled by the soft core 3 and spin of the ball can be controlled. This reduces the amount of spin and increases the shot angle, obtaining a long carry distance.

One embodiment of the present invention is described above; however, the present invention is not limited to this and various modifications are possible as long as they do not depart from the scope of the invention. For example, in the above embodiment, the carry distance of the ball is improved by setting the hardness of the core 3 less than those of the intermediate layers 5 and 7; it is also possible to make the hardness of the core 3 greater than those of the intermediate layers 5 and 7. With this constitution, because the intermediate layers are softer than the core, when the intermediate layers start rotating, the core follows this motion, increasing the amount of spin of the ball. Therefore, although the carry distance is reduced, a high spin performance can be attained.

Neither is the shape of the ribs 51 limited to the above. For example, in the above embodiment, the ribs 51 are formed along great circles; however, the ribs 51 need not necessarily have this structure as long as a plurality of concave portions 52 in which the second intermediate layers 7 can be placed.

Figure 3:
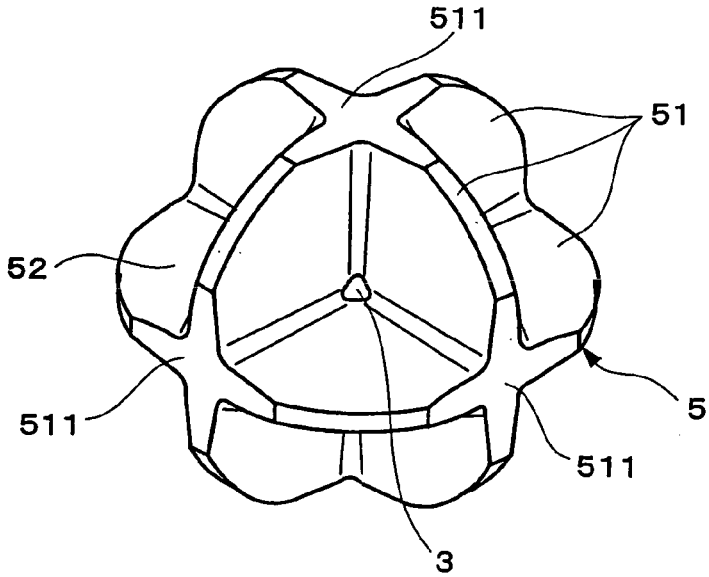
FIG. 3 is a perspective view showing another example of the first intermediate layer of the golf ball of FIG. 1.
Figure 4:
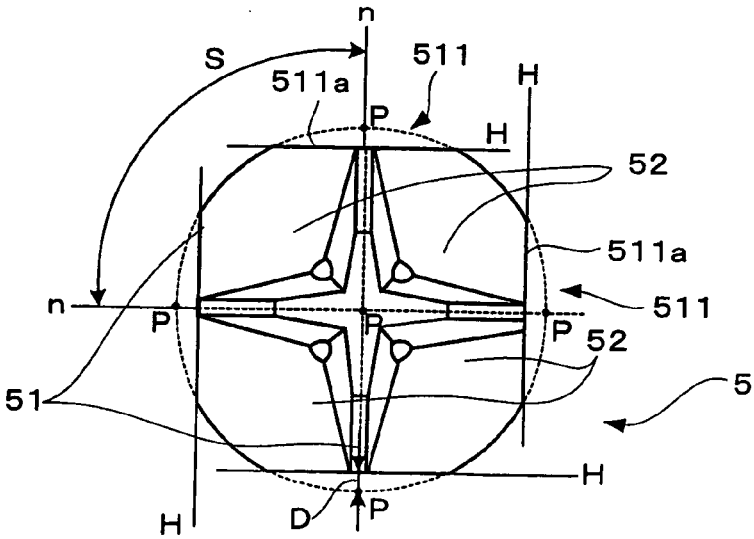
FIG. 4 is a cross-sectional view showing the first intermediate layer of FIG. 3.

As shown in FIG. 3, it is also possible to form a notch in a portion of the ribs 51. In this example, each rib 51 of the first intermediate layer 5 has a notch 511 at the intersection of the great circles. Specifically, as shown in FIG. 4, the notch 511 is structured so as to have a bottom surface 511*a* extending along a plane H perpendicular to the normal line of the core that passes through the intersection P of the great circles. In other words, the notch 511 is formed by excising the rib 51 at the plane H. Note that it is preferable that the depth D of the notch 511, i.e., the length from the top portion of the virtual rib 51 without a notch 511 to the innermost portion of the notch 511, be 1.2 to 2.4 mm.

Figure 5:
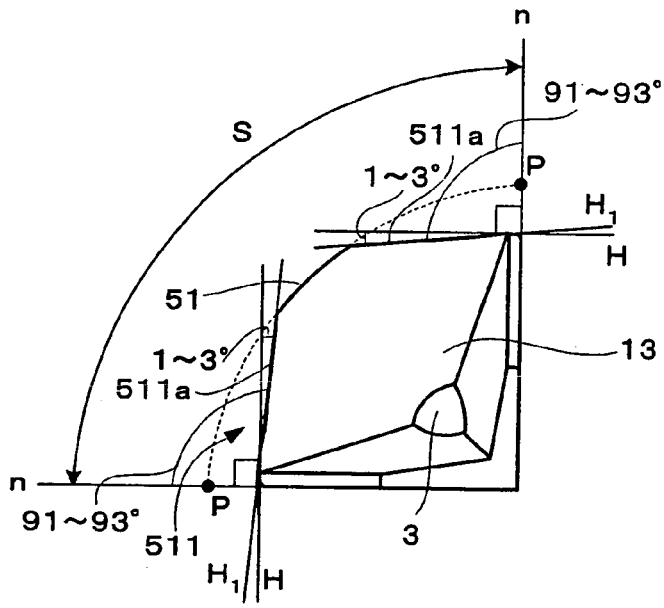
FIG. 5 is a cross-sectional view showing another example of the first intermediate layer of FIG. 3.

By forming notches 511 in this manner, four concave portions 52 that are arranged so as to have their common center at an intersection P of the great circles are made to communicate with each other, and the material for the intermediate layer can readily spread between the concave portions 52 via the notch 511. In this case, as shown in FIG. 5, it is also possible to form the bottom surface 511*a* of the notch 511 along a plane $H_1$ that extends away from the plane H by being slanted toward the center of the rib 11 by 1 to 3°, i.e., a plane having an angle made between the normal line of the core 3 passing the intersection P is 91 to 93° as viewed from the front. This arrangement enables the angle to serve as a draft, and, for example, when a core is molded using two molds, such as an upper mold and a lower mold, the core 3 can easily be removed from the mold.

Figure 6:
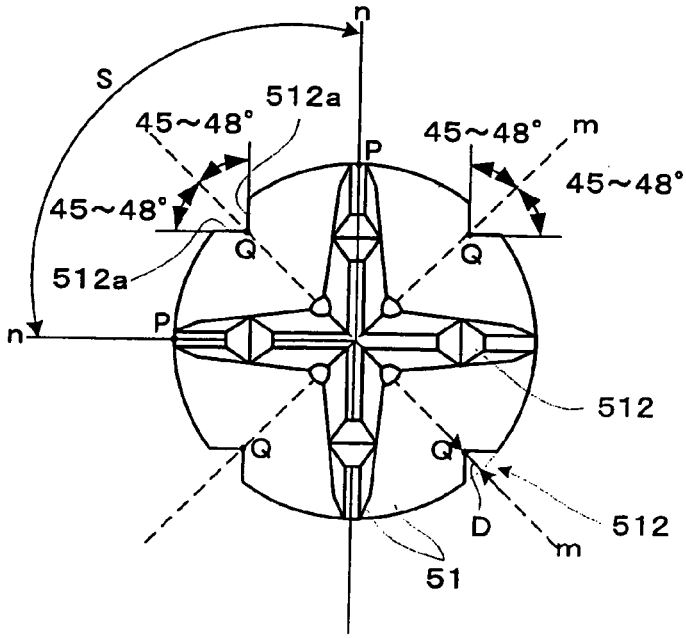
FIG. 6 is a cross-sectional view showing still another example of the first intermediate layer of FIG. 3.

It is also possible to form a notch in the middle of the circular arc section S formed between each intersection P of each rib 51. In other words, as shown in FIG. 6, it is possible to form a notch 512 so as to have two bottom surfaces 512*a* each extending in the directions of the intersections P from a point Q on a normal line m of the core 3 that passes through the mid point of each circular arc section in the radial direction. In this case, it is preferable that the angle between the bottom surface 512*a* and the normal line m be 45 to 48° as viewed from the front. This arrangement makes it possible to easily remove the core 3 from the mold.

Figure 7:
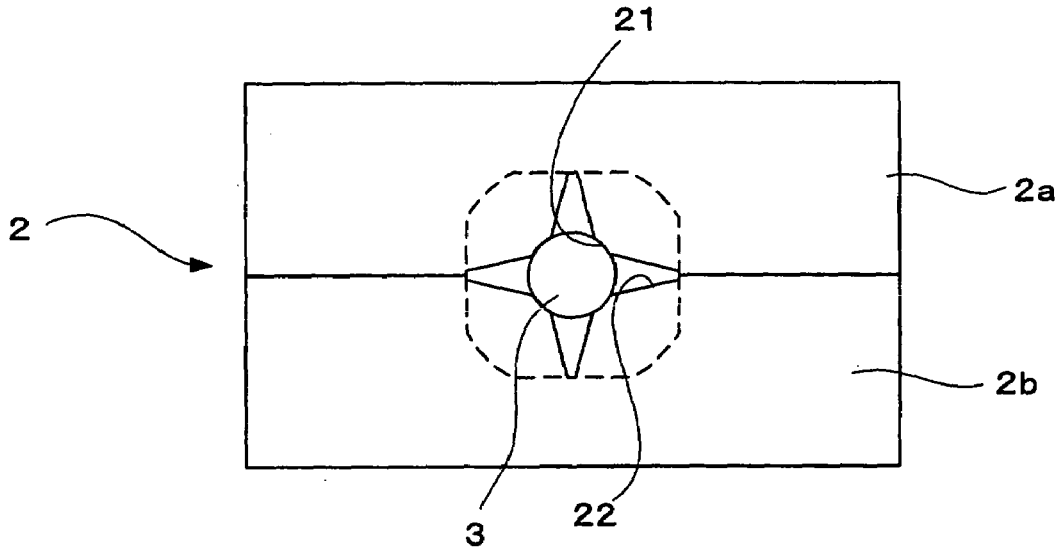
FIG. 7 is a diagram showing a method for manufacturing a golf ball having the first intermediate layer of FIG. 3.
Figure 7:
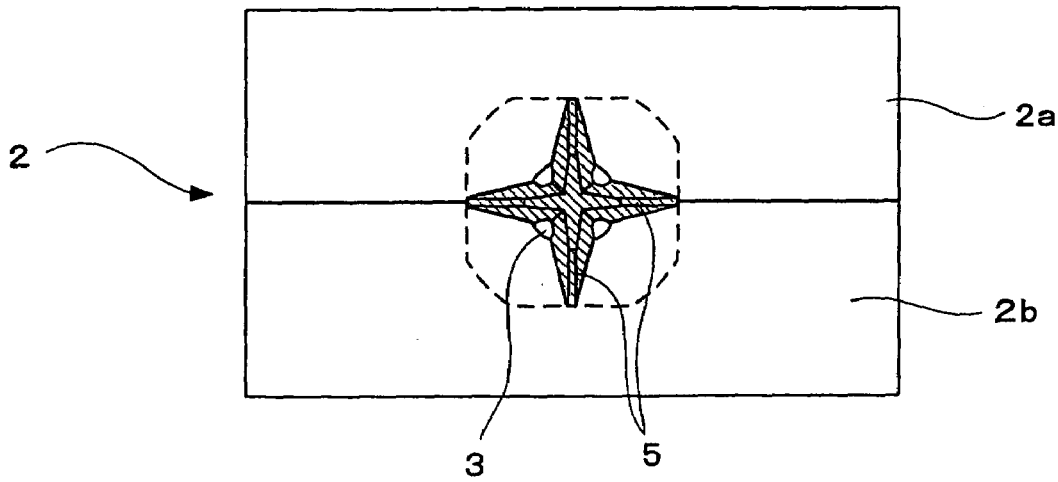
Figure 8:
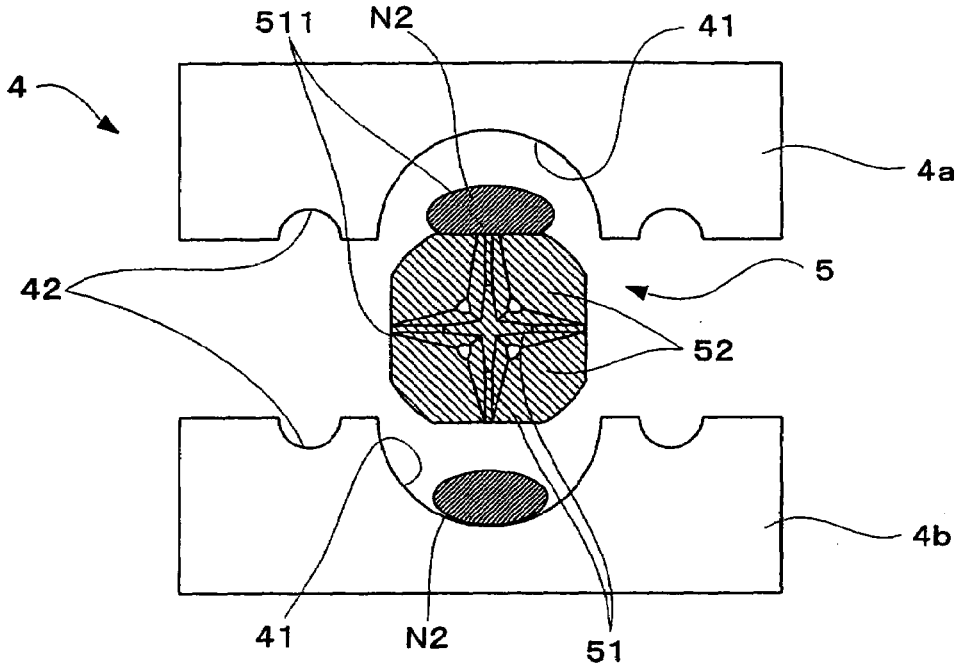
FIG. 8 is a diagram showing a method for manufacturing a golf ball having the first intermediate layer of FIG. 3.
Figure 8:
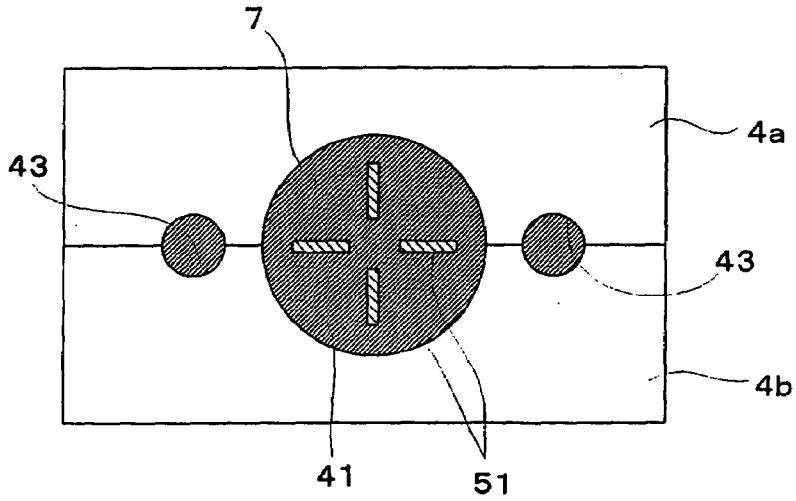

Hereunder, one example of a method for manufacturing a golf ball having the above structure is explained with reference to drawings. A method for manufacturing a golf ball wherein an intermediate layer is formed from a rubber composition is explained below. FIGS. 7 and 8 show a method for manufacturing a four-piece golf ball having a first intermediate layer as shown in FIG. 3.

A rubber composition is first subjected to press molding in a mold, for example, at a temperature in the range from 130 to 160° C. for 5 to 25 minutes, forming a core 3. The core 3 may be formed from elastomers as described above, and, in this case, the core can be formed by injection molding instead of press molding. The thus formed core 3 is placed in the first mold 2 shown in FIG. 7(*a*). The first mold 2 comprises an upper mold 2*a* and a lower mold 2*b*, and each of the upper mold 2*a* and a lower mold 2*b* comprises a hemispherical core receiving part 21 corresponding to the surface of the core 3. Cavities 22 for the ribs 51 are formed on the surfaces of the core receiving part 21. The cavity 22 is formed of a plurality of grooves formed along great circles of the core receiving part 21, wherein the grooves at the intersections of the three great circles are shallower than elsewhere. This makes it possible to obtain the notch 511 as described above.

By roughly finishing the surface of the cavity 22, it is possible to make fine irregularities on the surface of the obtained ribs 51, thus increasing the contact area with the second intermediate layer 7.

The core 3 is then placed in the core receiving part 21 in the first mold 2 as shown in FIG. 7(*b*), and an unvulcanized rubber composition N1 for the first intermediate layer is placed in the cavity 22. The rubber composition is then fully vulcanized, for example, at a temperature in the range from 140 to 165° C. for 10 to 30 minutes while conducting press molding to form the first intermediate layer 5, i.e., a plurality of ribs 51, around the surface of the core.

Subsequently, the half-finished product comprising the core 3 and the first intermediate layer 5 is released from the first mold 2 and placed in a second mold 4. As shown in FIG. 8(*a*), the second mold 4 comprises an upper mold 4*a* and lower mold 4*b*. Each of the upper mold 4*a* and the lower mold 4*b* comprises a spherical cavity 41 corresponding to the outermost diameter of the ribs 51. In other words, the mold is structured so that the top portions of the ribs 51 contact the surfaces of the cavities 41. The cavities 41 of the upper mold 4*a* and the lower mold 4*b* have the same kind of roughly finished surfaces as that of the first mold 2, and a plurality of concave portions 42 for holding excess flow are formed around the each cavity 41.

As shown in FIG. 8(*a*), an unvulcanized rubber composition N2 is inserted into the cavity 41 of the lower mold 4*b*, another rubber composition N2 is placed on top of the half-finished product obtained above, and the half-finished product is placed between the upper mold 4*a* and the lower mold 4*b*. Subsequently, as shown in FIG. 8(*b*), the upper mold 4*a* and the lower mold 4*b* are attached and the rubber composition N2 is fully vulcanized at a temperature in the range from 140 to 165° C. for 10 to 30 minutes, while conducting press molding, forming the second intermediate layer 7.

Figure 9:
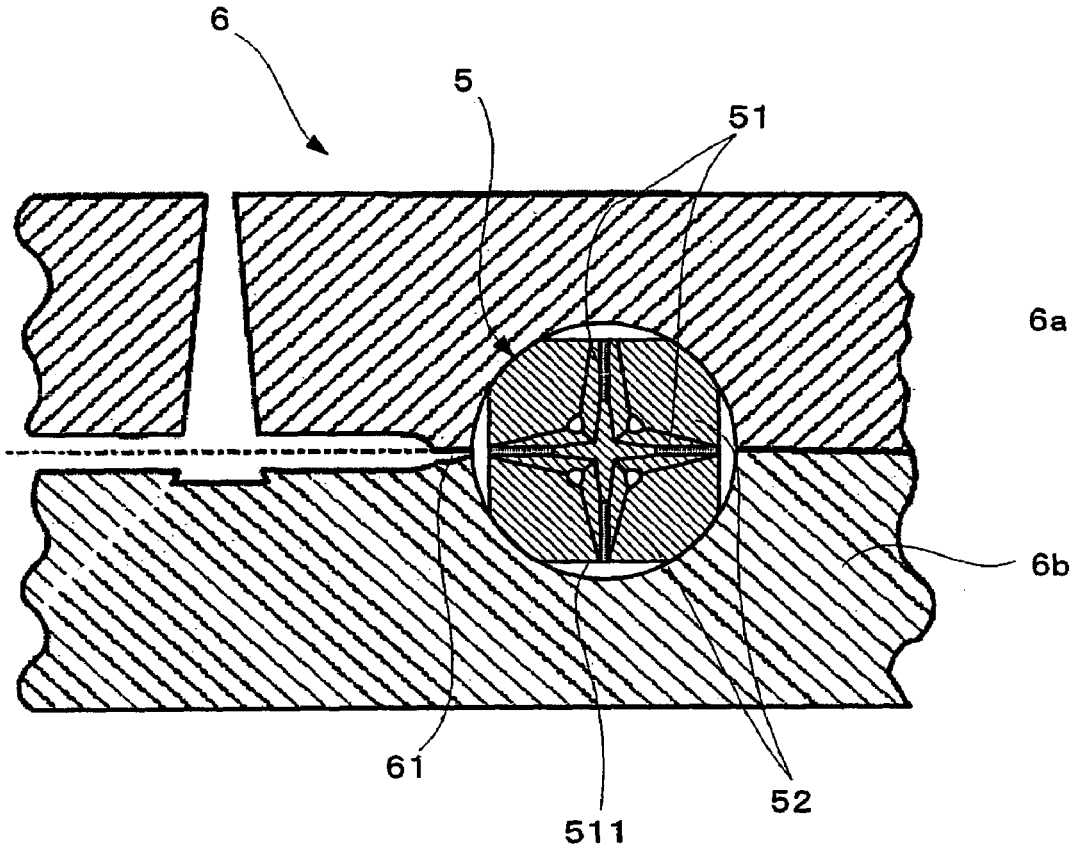
FIG. 9 is a diagram showing another example of the method for manufacturing a golf ball of FIG. 7.

Here, the rubber composition N2 placed on top of the half-finished product and in the cavity 41 of the lower mold 4*a* is inserted into the concave portion 52 while being pressed toward the surface of the half-finished product. As described above, because the adjacent concave portions 52 communicate with each other via the notch 511, the rubber composition N2 spreads throughout the concave portions 52 and is uniformly distributed. It is also possible to form the second intermediate layer 7 by injection molding, for example, using a mold 6 shown in FIG. 9. In this case, if no notch 511 is provided, it is necessary to provide the mold with a gate for each concave portion 52 to uniformly place the rubber composition N2 therein; however, by providing notches 511 to the rib 51, it is possible to uniformly place the rubber composition in the concave portions 52 even by inserting the rubber composition from a gate 61 after placing the half-finished product in the molds 6*a* and 6*b*.

Because the notches 511 are formed on the ribs 51 and the adjacent concave portions 52 communicate with each other via the notch 511, the rubber composition N2 can spread throughout the concave portions 52 when pressed from any position on the surface of the half-finished product. This makes it possible to cover the half-finished product with the second intermediate layer 7 by a single press-molding step, significantly reducing manufacturing time. Here, the second intermediate layer 7 is formed from a rubber composition;

however, it is also possible to form it from an elastomer. This makes it possible to form the second intermediate layer 7 by injection molding.

When formation of the second intermediate layer 7 is completed, a half-finished product comprising the core 3, the first and the second intermediate layers 5 and 7 are released from the second mold 4. Subsequently, when the surface of the half-finished product is covered with a cover 9 having predetermined dimples by press molding or injection molding, a four-piece golf ball can be obtained.

In the above description, a method for manufacturing a golf ball having an intermediate layer provided with notches is explained; however, a golf ball without notches can be manufactured by a similar manner. However, when notches are not provided, it is necessary to conduct press molding so that the second intermediate layer can be distributed throughout the concave portions, or, when injection molding is conducted, a plurality of gates corresponding to each concave portion must be provided.

An example of a method for manufacturing the multi-piece ball of the present invention is explained above. The method of the present invention makes it possible to manufacture golf balls suitable for different purposes merely by changing the materials. For example, by setting the hardness of the core 3 less than those of the intermediate layers 5 and 7, a golf ball focusing on obtaining a long carry distance can be manufactured, and by setting the hardness of the core 3 greater than those of the intermediate layers 5 and 7, golf balls focusing on high spin performance can be manufactured.

In the above embodiment, a golf ball in which hardness is different between the core and each intermediate layer is explained; however, it is also possible to differentiate the specific gravities in intermediate layers 5 and 7, and the core 3. For example, it is possible to set the specific gravity of the first intermediate layer 5 less than that of the second intermediate layer 9 and that of the core 3 less than that of the first intermediate layer 5, so that the specific gravity of the ball as a whole gradually decreases from the cover 9 side to the inner radial direction. This arrangement increases the moment of inertia of the ball, and therefore spin when hit can be reduced and the spin can be maintained for a long time. As a result, the carry distance of the ball can be enhanced.

In contrast, when the specific gravity of the second intermediate layer 7 is made less than that of the first intermediate layer 5, and that of the core 3 is made greater than those of the first intermediate layer 5, the specific gravity gradually increases from the cover 9 to the inner radial direction. Because this arrangement reduces the moment of inertia of the ball, the amount of spin of the ball when hit is increased, improving the spin performance of the ball.

Therefore, by employing the manufacturing method of the present invention, golf balls having different properties such as a long carry distance and excellent spin performance can be obtained merely by changing the materials for the core using the same mold. As a result, a manufacturing facility including the mold can be simplified and costs be significantly reduced.

In the above manufacturing method, as shown in FIG. 7, the first mold 2 comprises a core receiving part 21 and cavities 22 for forming ribs 51 provided on the surface of the core receiving part 21 wherein the first intermediate layer 5 is placed while holding the core 3 in the core receiving part 21. This arrangement makes it possible to expose the core 3 through the bottoms of the concave portions 52 as shown in FIG. 2(*b*) immediately after the first intermediate layer 5 is placed. Depending on the dimensions of the core 3 and/or the height of the ribs 51, it is also possible to structure the core 3 so as to be unexposed through the bottoms of the concave portions 52 and be covered with the first intermediate layer 5. As long as the concave portions 52 are formed in a cone-like shape, the effects of the present invention can also be achieved by even this structure.

In this case, the first mold 2 is provided with a spherical space larger than the core and the cavity for the ribs extends from the spherical space. Instead of holding the core in the core receiving part, the core is held in the spherical space by, for example, holding pins which can be moved forward and backward, and the first intermediate layer is then placed. Thereafter, when the holding pins are removed before the first intermediate layer is completely cured, it is possible to hold the core at the center of the first intermediate layer.

EXAMPLE

Examples and Comparative Examples of the present invention will be explained below. Here, the four types of four-piece golf balls according to the present invention are compared with two types of golf balls having a rib height that is outside the range of the present invention and two types of known golf balls having a core without ribs. In the conventional four-piece golf balls, a core, a first intermediate layer, a second intermediate layer and a cover are laminated in that order from the inner radial direction toward the outside.

The golf balls of Examples 1–4 and Comparative Examples 1–4 are formed from the components shown in FIG. 10. In this figure, BR stands for butadiene rubber, peroxide stands for dicumyl peroxide, and HIMILAN 1706 and HIMILAN 1605 are names of two products manufactured by Mitsui-DuPont Polychemicals Co., Ltd.

The size of each ball is as shown in FIG. 11. Each ball was press molded in such a manner as to have the components, proportions, and dimensions described above. As shown in FIG. 11, in Examples 1 to 3, golf balls having a core softer than the intermediate layers were manufactured to focus on obtaining a long carry distance. In contrast, in Example 4, balls having a core hardness greater than those of the intermediate layers were manufactured to focus on obtaining excellent spin performance.

Using the golf balls obtained in the Examples and Comparative Examples described above, hitting tests were conducted using a hitting robot (manufactured by Miyamae Co., Ltd.) with a number one wood (1W: Mizuno Corporation; Mizuno 300S-II 380, loft angle: 9°, length: 44.75 inches (113.66 mm), shaft hardness: S)) and a number five iron (5I: manufactured by Mizuno Corporation T-ZOID·MX-15, loft angle: 27°, length: 37.5 inches (95.25 mm), shaft hardness: S), and tests of the feeling when hit were conducted by ten amateurs using a 1W. FIG. 12 shows the results.

In the hitting tests when a 1W was used, the head speed was set at 43 m/s and when a 5I was used, the head speed was set at 38 m/s. Balls obtained in Examples 1 to 4, which included ribs, exhibited longer carry distances compared to the balls without ribs. Although the carry distance of the balls obtained in Example 4 was shorter than the other Examples, as indicated in the test result in which a 5I was used, they exhibited shorter run and excellent spin performance. Balls in all Examples exhibited excellent feeling when hit.

Because the ribs are too short in the balls of Comparative Example 1, satisfactorily functionally graded properties cannot be achieved. For example, in the test conducted using a 1W, because the deformation of the ball is great, the ball bounce resilience decreases affected by the core that is softer than the ribs, and the carry distance is less than desired. In the test conducted using a 5I, because of the short ribs, the feeling when hit was hard. Because the balls obtained in Comparative Example 2 have thick second intermediate layers, i.e., the soft region is large, the ball bounce resilience is reduced and the carry distance is less than expected. In the Comparative Examples 3 and 4, because no ribs are provided, there is a loss in striking force and the carry distance is less than expected.

It is clear that the balls obtained in Examples of the present invention achieve a long carry distance and excellent hit feeling, and are superior to those obtained in the Comparative Examples.

The invention claimed is:

1. A multi-piece golf ball comprising:

a core;

a first intermediate layer;

a second intermediate layer; and a cover, wherein the first intermediate layer comprises a plurality of ribs formed on the core, the second intermediate layer is placed in concave portions surrounded by the ribs, the cover forms an outermost layer, the ribs extend in such a manner that the widths thereof become wider from the cover side to the core side, the concave portions are formed into a cone-like shape by the side surfaces of the ribs, the hardnesses of the core, the first intermediate layer and the second intermediate layer are different from each other, and the hardness of the first intermediate layer is greater than that of the second intermediate layer.

2. A multi-piece golf ball according to claim 1, wherein the hardness of the core is less than that of the second intermediate layer.

3. A multi-piece golf ball according to claim 1, wherein the hardness of the core is greater than that of the first intermediate layer.

4. A multi-piece golf ball according to claim 1, wherein the rib height is in the range from 6.4 to 11.2 mm.

5. A multi-piece golf ball according to claim 1, wherein the diameter of the core is in the range from 15.1 to 28.3 mm.

6. A multi-piece golf ball according to claim 1, wherein the ribs extend along three great circles drawn around the core so as to intersect each other at right angles.

7. A multi-piece golf ball according to claim 1, wherein each of the ribs is provided with a notch so as to form a passageway between adjacent concave portions.

8. A multi-piece golf ball according to claim 7, wherein the ribs extend along three great circles drawn around the core so as to intersect each other at right angles, and form circular arc sections between each intersection of each rib, each circular arc section of the ribs divided at the intersections of the great circles is provided with a said notch, and the notch has a plane that extends from one point of the normal line of the core passing through the intersection of the great circles toward the circular arc section, the plane having an angle that is not smaller than 90° relative to the normal line.

9. A multi-piece golf ball according to claim 7, wherein the ribs extend along three great circles drawn around the core so as to intersect each other at right angles, and form circular arc sections between each intersection of each rib, each circular arc section of the ribs divided at the intersections of the great circles is provided with a said notch, the notch is formed in the middle of the circular arc section in the circular direction and has two planes each extending toward the intersection side from one point on the normal line of the core passing through the mid point of each circular arc section in the circular direction, and the angle formed between each of the planes and the normal line is 45 to 48°.

* * * * *